US008056444B1

(12) United States Patent
Van Straten et al.

(10) Patent No.: US 8,056,444 B1
(45) Date of Patent: Nov. 15, 2011

(54) AUTOMATED SURFACE COVERING REMOVAL MACHINE

(75) Inventors: Daniel J. Van Straten, Green Bay, WI (US); John M. Bastian, Manitowoc, WI (US); Terry S. Bosch, Manitowoc, WI (US)

(73) Assignee: TBD2, Inc., Manitowoc, WI (US)

( * ) Notice: Subject to any disclaimer, the term of this patent is extended or adjusted under 35 U.S.C. 154(b) by 185 days.

(21) Appl. No.: 12/255,392

(22) Filed: Oct. 21, 2008

Related U.S. Application Data

(60) Provisional application No. 61/040,853, filed on Mar. 31, 2008.

(51) Int. Cl.
*E04D 15/00* (2006.01)

(52) U.S. Cl. ..... 81/45; 299/37.1

(58) Field of Classification Search ..... 81/45–46; 299/36.1, 37.1; 254/131.5; 30/170
See application file for complete search history.

(56) References Cited

U.S. PATENT DOCUMENTS

| | | | | |
|---|---|---|---|---|
| 3,753,400 | A * | 8/1973 | Miller | 100/100 |
| 4,277,104 | A | 7/1981 | Sanchez | |
| 4,858,503 | A * | 8/1989 | Dike, Jr. | 81/45 |
| 5,628,284 | A * | 5/1997 | Sheen et al. | 119/840 |
| 5,641,206 | A * | 6/1997 | Craft | 299/37.1 |
| 5,741,047 | A | 4/1998 | Ordonez | |
| 5,863,100 | A * | 1/1999 | Martin | 299/37.1 |
| 5,921,155 | A | 7/1999 | Faller et al. | |
| 6,095,015 | A | 8/2000 | Phelan | |
| 6,711,971 | B1 | 3/2004 | Morin | |
| 6,799,501 | B2 * | 10/2004 | Yo et al. | 91/361 |
| 7,222,556 | B2 * | 5/2007 | Tyler | 81/45 |
| 7,313,985 | B2 | 1/2008 | Willis | |
| 2006/0117910 | A1 * | 6/2006 | Gendron | 81/45 |
| 2006/0156866 | A1 * | 7/2006 | Ingell | 81/45 |
| 2006/0191378 | A1 * | 8/2006 | Linscott | 81/45 |
| 2009/0188350 | A1 * | 7/2009 | Becoat | 81/45 |
| 2010/0319497 | A1 * | 12/2010 | Creato et al. | 81/45 |

* cited by examiner

*Primary Examiner* — Debra S Meislin
(74) *Attorney, Agent, or Firm* — Andrus, Sceales, Starke & Sawall, LLP

(57) ABSTRACT

An automated surface covering removal machine having a handle, a housing, a lever member, a reciprocating cylinder and edge means for providing vertical or near vertical movement of the edge means relative to the surface covering to facilitate removal of the surface covering is disclosed. The surface covering may be shingles, carpeting, linoleum, or any other type of surface covering. The automated surface covering removal machine is lightweight and easy to use and does not exert a debilitating backwards force on the user. The reciprocating cylinder allows for a variable stroke height of the tooth bar allowing for more rapid removal of a surface covering.

28 Claims, 8 Drawing Sheets

AUTOMATED SURFACE COVERING REMOVAL MACHINE

CROSS-REFERENCE TO RELATED APPLICATIONS

This application claims priority to Provisional Application Ser. No. 61/040,853 filed on Mar. 31, 2008.

BACKGROUND OF THE INVENTION

Conventionally, removal of surface coverings such as shingles from a roof required intense physical labor with manual implements. Several attempts have been made to automate the process. However, such attempts were heavy and cumbersome machines that are not user friendly. The prior art machines commonly were cumbersome and would exert a backward force on the operator and require the operator to apply a force to hold the prior art machines in position.

The present invention provides an automated surface covering removal machine comprising a handle, housing, lever member, reciprocating cylinder and tooth bar that provides vertical or near vertical movement of the tooth bar relative to the surface covering and fasteners that are to be removed. With such vertical movement, there is no backward force exerted on a user when the tooth bar moves from an upper to a lower position. The automated surface covering removal machine of the present application also is lightweight and, therefore, not cumbersome to a user. The reciprocating cylinder of the automated surface covering removal machine of the present application has variable, proportional, stroke height and a removable tooth bar, along with an adjustable handle with ergonomics. The automated surface covering removal machine of the present application is constructed with a replaceable bottom pan on the housing for easy and economical change of parts due to wear and tear after use.

DETAILED DESCRIPTION OF THE INVENTION

Figure 1:
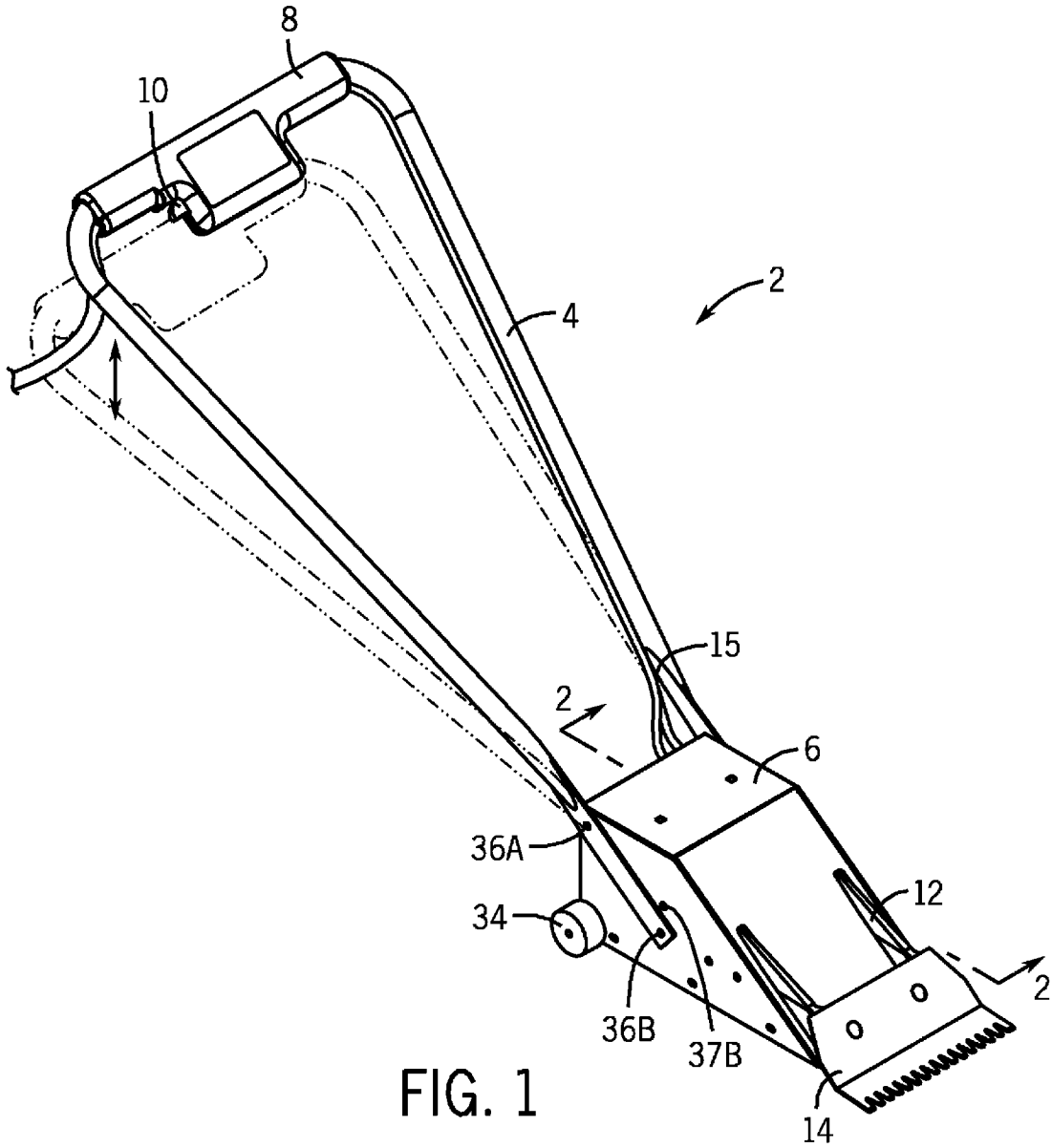
FIG. 1 is a perspective view of the automated surface covering removal machine of the present application demonstrating the adjustable handle.

The surface covering removal machine 2 comprises a handle 4, a housing 6, a lever member 12, a removable edge means 14 and a reciprocating cylinder 18. The surface covering removal machine 2 may be used in diverse environments, from outdoor removal of roofing shingles to indoor removal of linoleum or carpeted floors. The detailed description that follows is directed to a shingle removal embodiment, but one of ordinary skill in the art will understand that the illustrated exemplary embodiment will be applicable to other contemplated embodiments that may benefit from the upwardly thrusting movement principles disclosed in this application.

Figure 4:
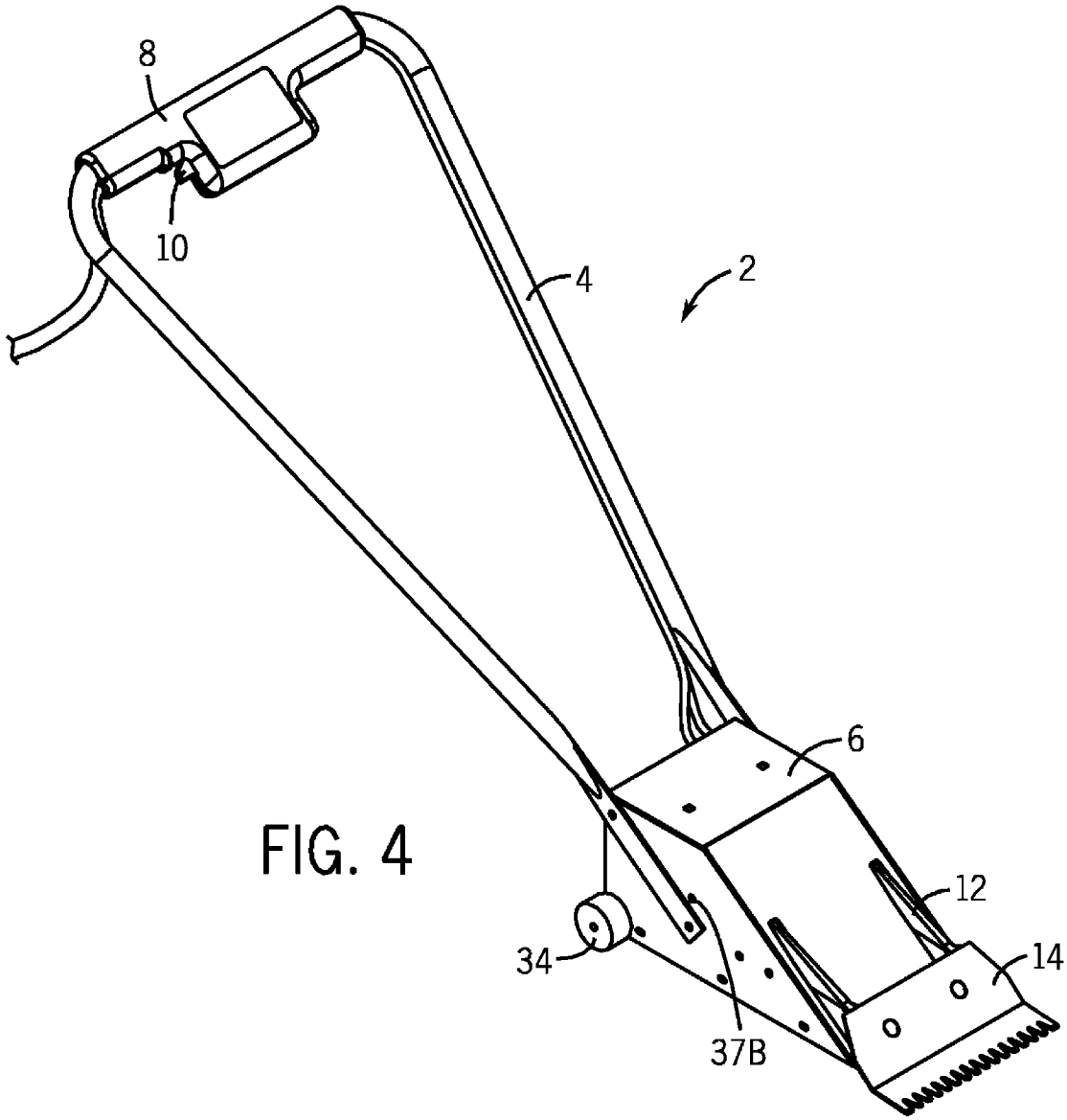
FIG. 4 is a perspective view of the automated surface covering removal machine of the present application in a ready to use position.
Figure 5:
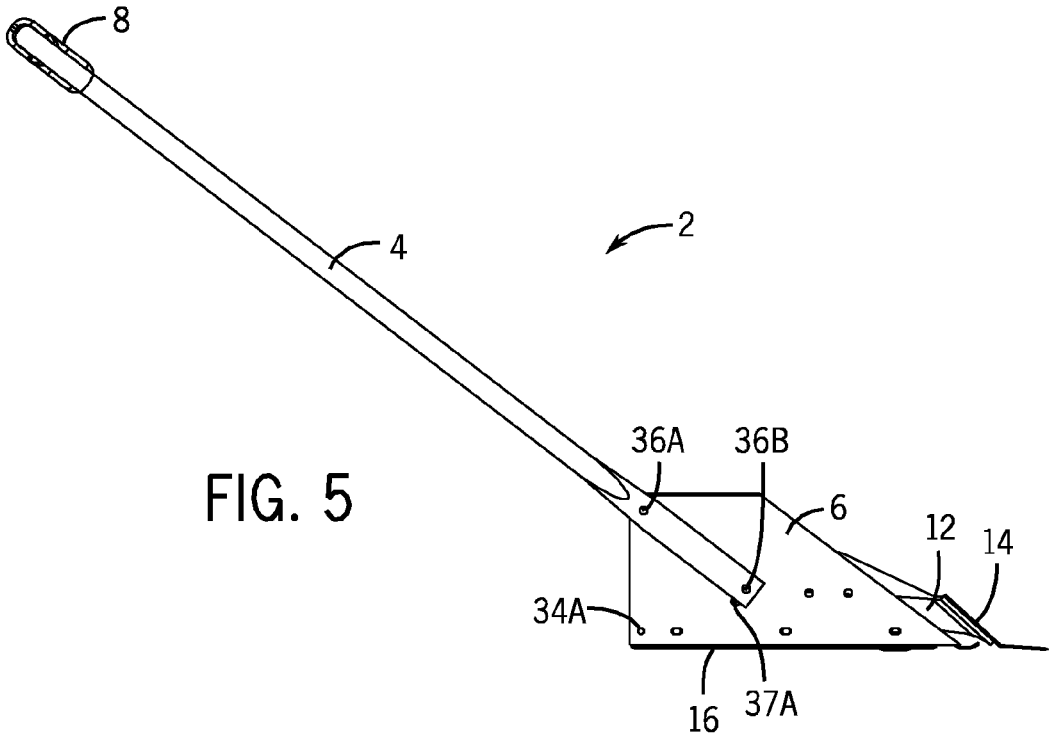
FIG. 5 is a side view of the automated surface covering removal machine of the present application with the handle in a first position.
Figure 6:
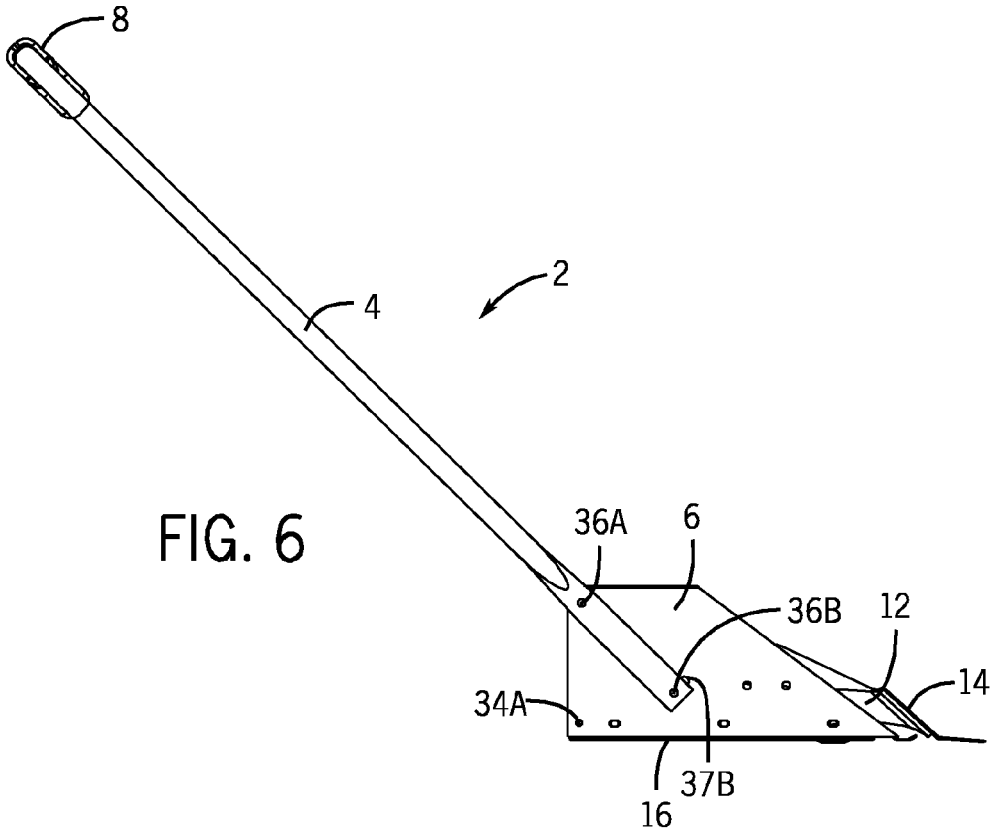
FIG. 6 is a side view of the tooth bar and front portion of the automated surface covering removal machine of the present application with the handle in a second position.

Referring to FIG. 1, the handle 4 is attached to the housing 6, and includes a handle grip 8 and a trigger 10. The handle 4 of the automated surface covering removal machine 2 is adjustable in height to be ergonomic. Mechanical fasteners 36A, 36B attach the handle to the housing 6. The operator selects an appropriate mounting hole (e.g., 37A, 37B; see, FIGS. 4-6) to insert the mechanical fasteners 36A, 36B for adjusting the height of the handle 4. Alternatively, the handle 4 may be positioned within a slot, giving the operator and infinitely adjustable range of heights from a minimum to a maximum position.

The handle grip 8 is designed to be ergonomic allowing the operator to place his or her hands in a comfortable position. Trigger 10 requires very little effort to activate. Trigger 10 is connected to reciprocating cylinder 18, pneumatically in one embodiment, electrically or hydraulically in other embodiments, to raise and lower lever member 12 and removable edge means 14 from an upper to a lower position. Conduits or hoses 15 may be used to connect the trigger 10 to the reciprocating cylinder 18, as further demonstrated in FIG. 2.

Figure 7:
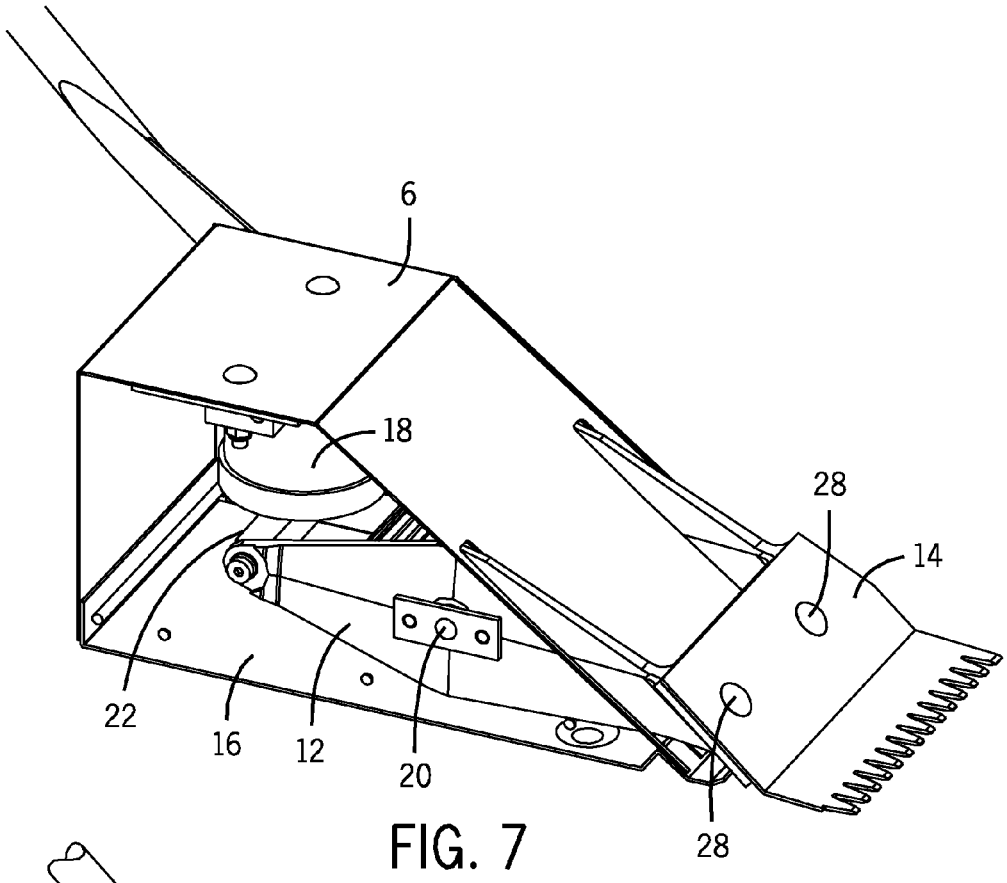
FIG. 7 is a sectional, perspective view of the housing and internal components of the automated surface covering removal machine of the present application.
Figure 8:
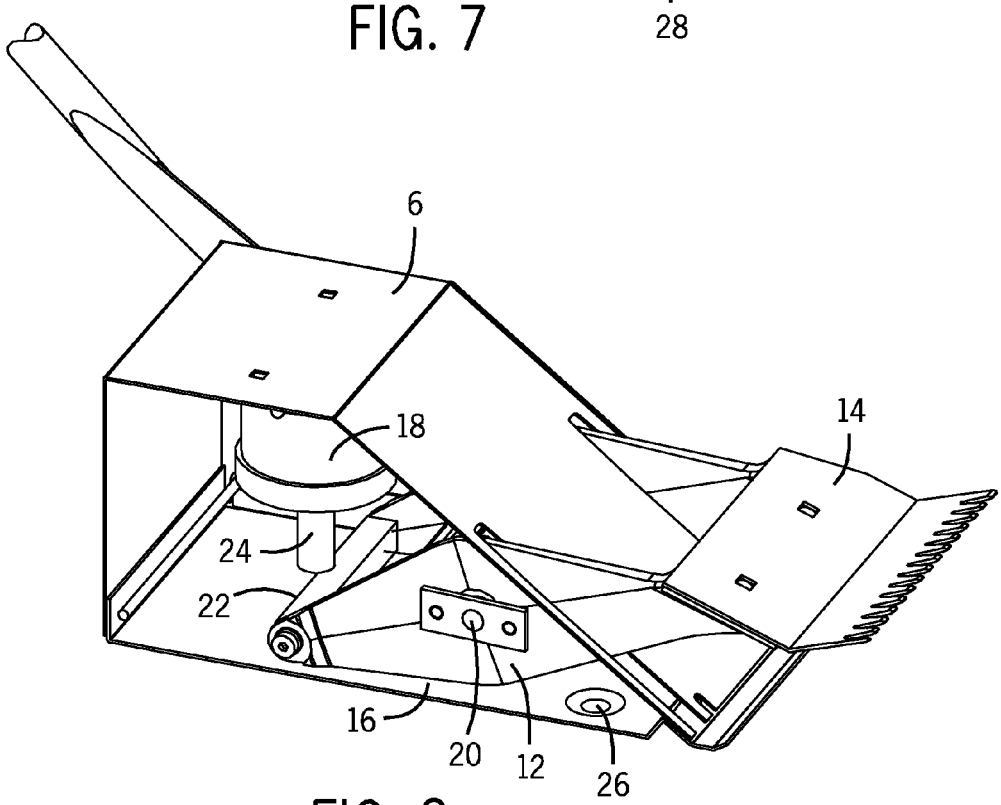
FIG. 8 is a sectional perspective view of the housing of the automated surface covering removal machine of the present application, with the lever member in a raised position.
Figure 9:
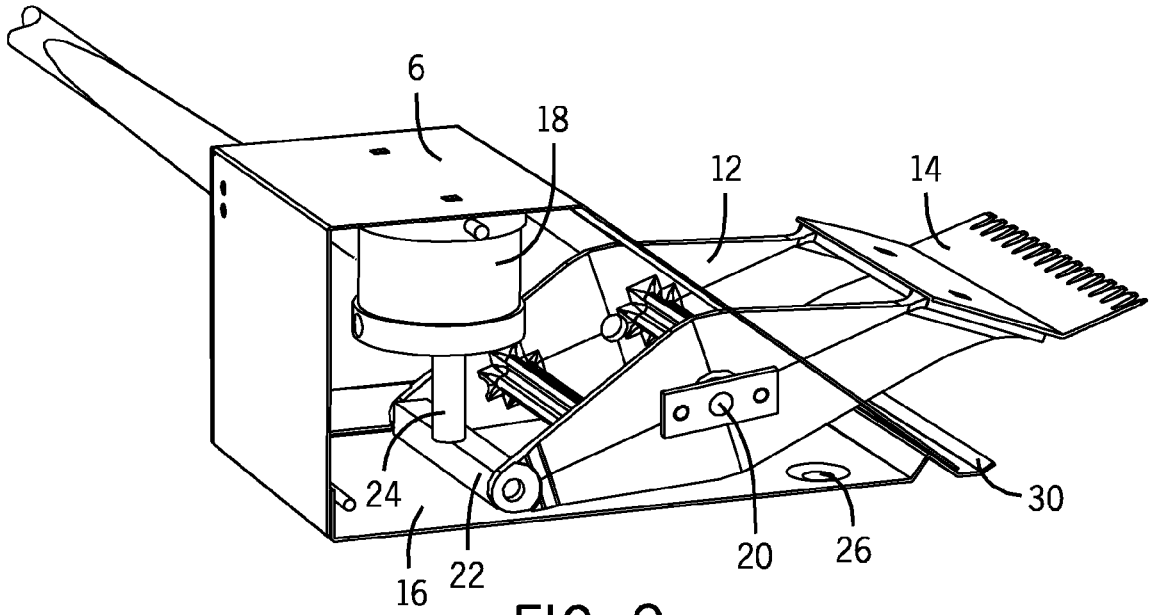
FIG. 9 is a sectional perspective view of the surface covering removal machine of the present application showing the lever member in a raised position.

Turning now to FIGS. 7-9, as mentioned, edge means 14 is removable and is attached to lever member 12 through mechanical fasteners 28. Mechanical fasteners 28 may be any type of mechanical fastener and preferably allow the user to easily remove the edge means 14 for replacement after wear.

Figure 12:
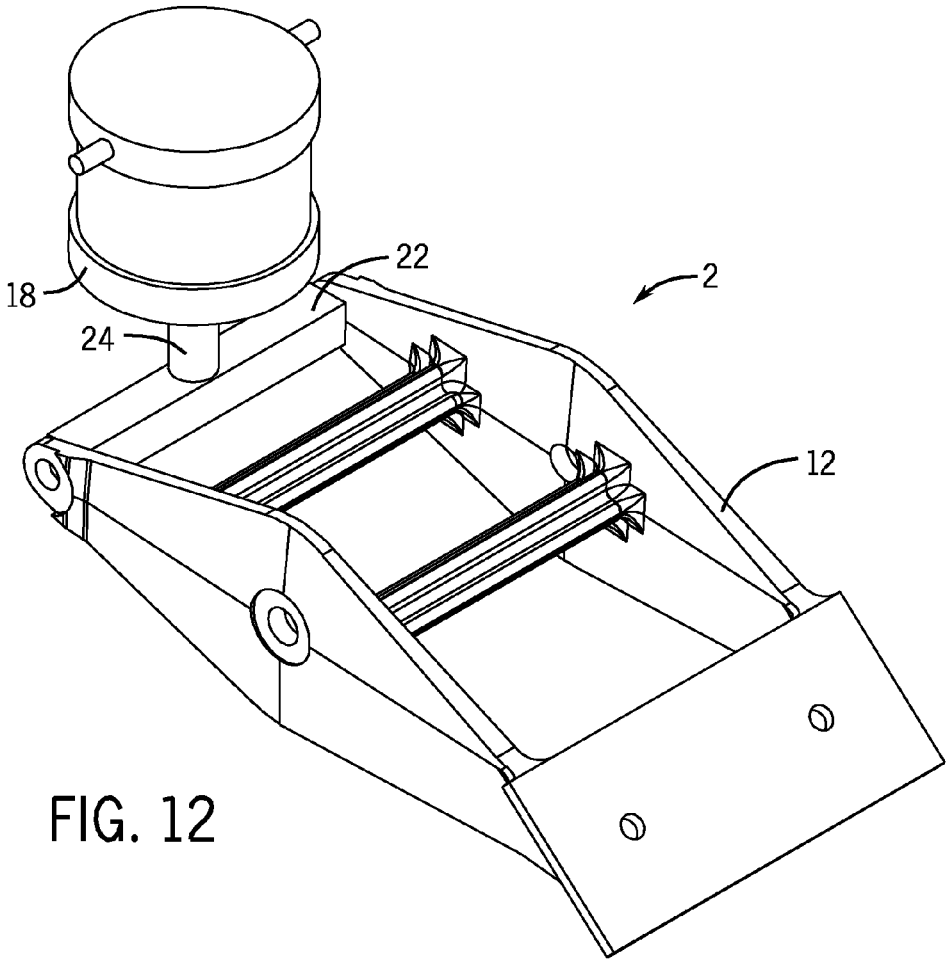
FIG. 12 is a perspective schematic view of the cylinder and lever assembly of the present application.

Reciprocating cylinder 18 may be attached to the top portion of the housing 6. The reciprocating cylinder 18 may be mounted to the housing in different manner as well. As shown in FIGS. 2, 3, 8, 9 and 12, reciprocating cylinder 18 includes a piston rod 24 attached to a lever member attachment shaft 22. Lever member attachment shaft 22 connects the reciprocating cylinder 18 to the lever member 12 as shown in FIG. 12, for one embodiment. Lever member 12 is attached to the housing through pivot shaft 20. By activating reciprocating cylinder 18, piston shaft 24 depresses lever member attachment shaft 22 downwardly, in turn, raising the front portion of the lever member 12 and removable edge means 14 upwardly, as demonstrated in a comparison between FIGS. 2 and 3.

Reciprocating cylinder 18 is, in one embodiment, a pneumatic reciprocating cylinder. In another embodiment, the reciprocating cylinder 18 is an electric reciprocating cylinder.

In yet another embodiment, the reciprocating cylinder 18 is a hydraulic reciprocating cylinder. In all respects, the reciprocating cylinder 18 has a variable stroke height. When an operator actuates trigger 10, the lever member 12 will raise upwardly and remain in the up position until the trigger 10 is released. If the trigger 10 is released before the lever member 12 is completely in the up position, the reciprocating cylinder will release and return the lever member to the down position. This proportional, variable stroke feature allows the operator to raise the edge means 14 only the necessary amount to loosen or remove, for example, shingle nails, resulting in less time required to remove and prepare a roof for new shingles.

The interaction between reciprocating cylinder 18 and lever member 12 permits the edge means 14 to be raised to a maximum height of 4 to 8 inches above the lowered position. This height allows the automated surface covering removal machine 2 to pull, for example, adjacent shingles loose from a greater distance, resulting in faster shingle removal. Moreover, the edge means 14 is raised upwardly and downwardly in a vertical or nearly vertical fashion because of the location of pivot shaft 20. The benefit of this vertical movement is that no backward force is exerted on the operator when the edge means moves from the upper to the lower position. Accordingly, the design is less fatiguing than prior art designs which exerted backward force on the operator.

Referring to FIGS. 5-9, housing 6 includes a bottom pan 16. Bottom pan 16 is readily replaceable due to excessive wear and tear that the bottom pan encounters during use of the automated shingle removal machine 2. The bottom pan 16 of housing 6 includes at least one embossment 26 on the surface that engages the roof. The at least one embossment 26 is, in one embodiment, located near the front portion of the bottom pan 16. The at least one embossment 26 reduces the surface area that is in contact with the roof and provides a ramp effect, making it easier to slide the automated shingle removal machine 2 on, around and over surfaces that are not always flush with one another. The bottom pan 26 also includes flange 30 that aids in negotiating uneven surface that have a significant change in height.

Figure 10:
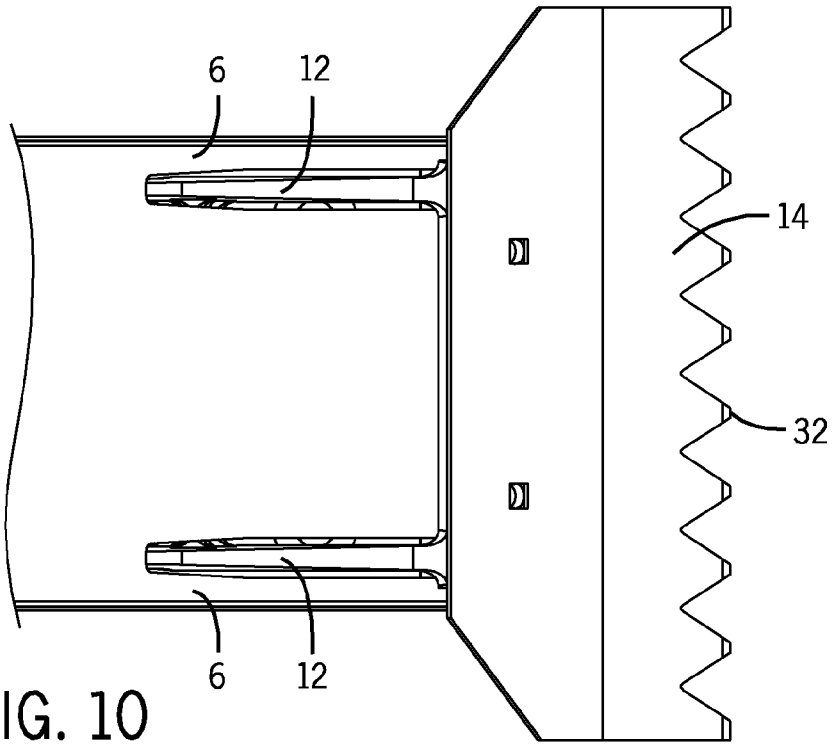
FIG. 10 is a top view of the housing, lever member and an embodiment of the removable edge means of the present application.
Figure 11:
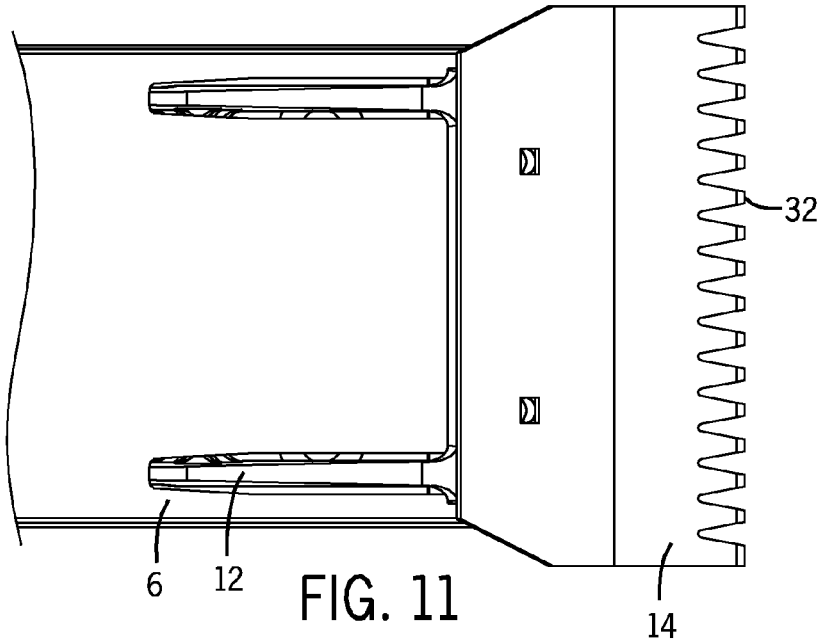
FIG. 11 is a top view of the housing, lever member and another embodiment of the removable edge means of the present application.

Referring now to FIGS. 10 and 11, the edge means 14 is removable from the lever member 12 to permit different designs of edge means 14 to suit particular roofing conditions. For example, the edge means of FIG. 10 has more widely spaced teeth 32 than the edge means of FIG. 11. As a further example, the edge means may comprise a multi-tooth edge, a serrated edge, a flat edge, a bladed edge, a chisel edge or other similar edge designs to facilitate surface covering removal.

Figure 2:
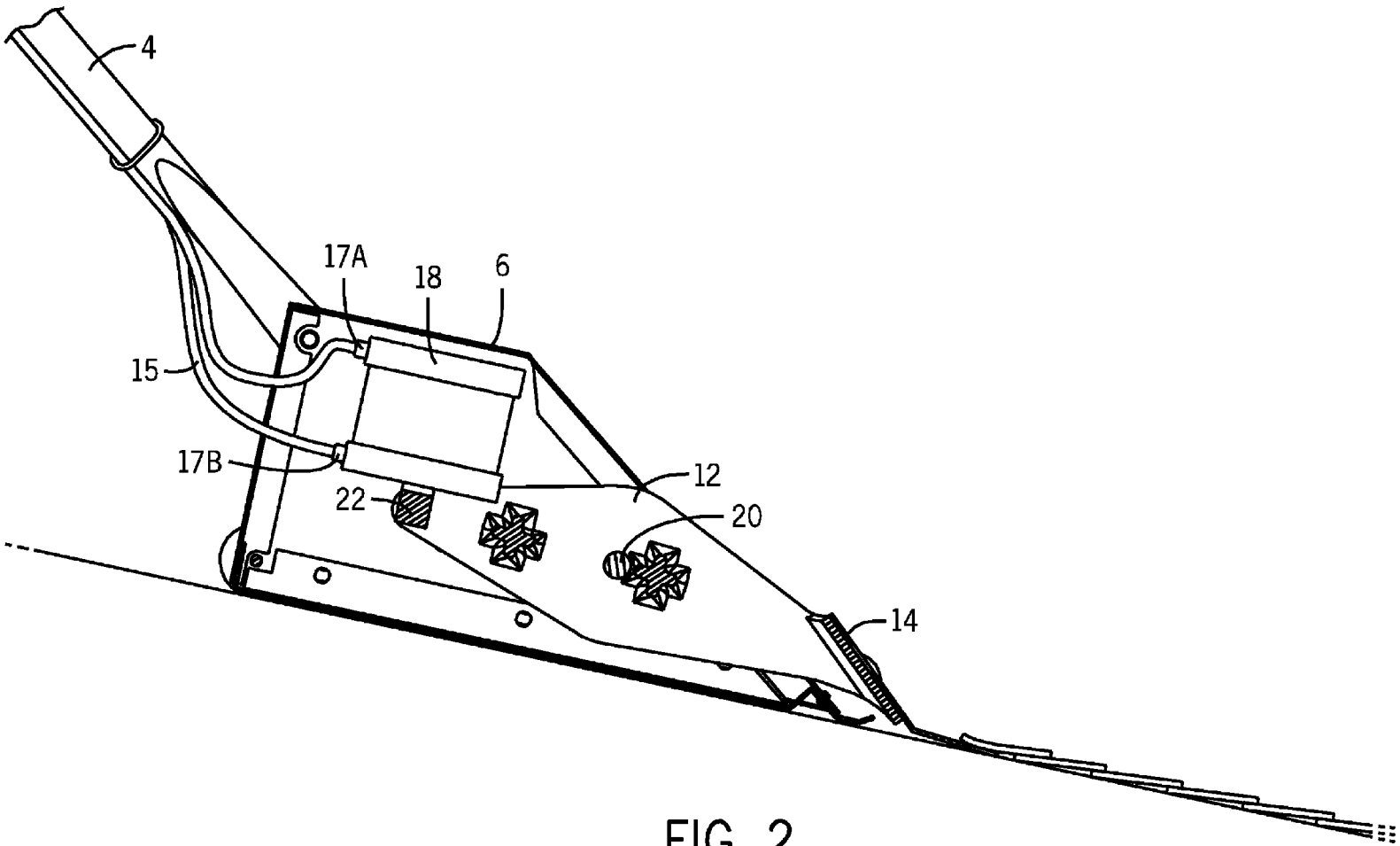
FIG. 2 is a sectional side view of the automated surface covering removal machine of the present application taken along line 2-2 of FIG. 1, with the lever member in a lowered position.
Figure 3:
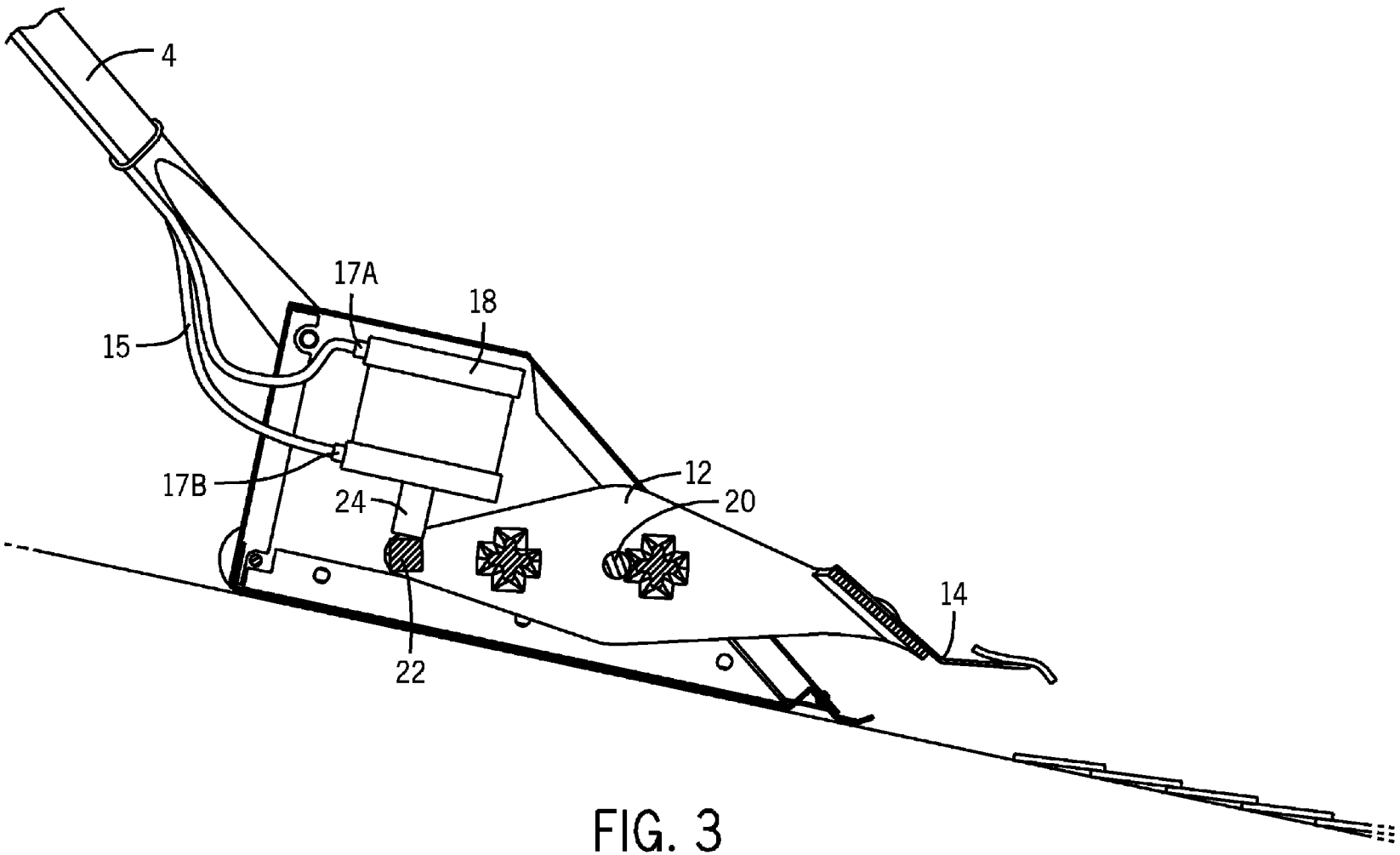
FIG. 3 is a sectional side view of the automated shingle removal machine of the present application showing the lever member in a raised position.

In one embodiment of the automated surface covering removal machine 2 of the present application, as demonstrated in FIG. 2, the reciprocating cylinder 18 is a pneumatic cylinder powered by a conventional air compressor. Hoses 15 may be connected through handle grip 8 and run through trigger 10 downwardly into the housing 6 and connect to the pneumatic reciprocating cylinder 18. Quick exhaust check valves 17A, 17B provide the connection between the hosing and the reciprocating cylinder 18. The quick exhaust valves 17A, 17B allow the lever member 12 to be raised and lowered quickly, and also exhaust into the housing 6 to assist in keeping the interior of housing 6 clean from dust and debris. As mentioned, when the trigger 10 is compressed, air will flow into the cylinder extending reciprocating cylinder piston 24 downwardly. However, the pneumatic reciprocating cylinder need not be fully extended before retracting; therefore, allowing for variable stroke lengths, proportional with trigger actuation.

Finally, referring back to FIGS. 1 and 4, the automated surface covering removal machine 2 may include wheels 34 for aid in transporting the machine 2. The wheels 34 may be attached to the housing at points 34A, or at other points, if desired.

It is apparent to those skilled in the art that the present invention as described herein contains several features, and that variations to the embodiments as disclosed herein may be made that embody only some of the features disclosed herein. From the foregoing description, certain terms have been used for brevity, clearness and understanding. No unnecessary limitations are to be implied therefrom beyond the requirement of the prior art because such terms are used for descriptive purposes and are intended to be broadly construed. The different configurations described herein may be used alone or in combination with other configurations. Various other combinations and modifications or alternatives may also be apparent to those skilled in the art. Such various alternatives and other embodiments are contemplated as being within the scope of the present disclosure.

What is claimed is:

1. An automated shingle removal machine comprising:

a handle;

the handle being connected to a housing;

the housing having a top portion and fully enclosing a user-acuatable reciprocating cylinder;

the reciprocating cylinder being mounted to the top portion of the housing, the reciprocating cylinder being oriented perpendicular to and extending downwardly from the top portion of the housing, the reciprocating cylinder further being operatively connected to a lever member at a proximal end of the lever member; and an edge means connected to the lever member at a distal end, the edge means adapted to move under shingles applied to a roof surface;

wherein when the reciprocating cylinder is actuated, the lever member and edge means are adjusted upwardly to facilitate removal of the shingles.

2. The automated shingle removal machine of claim 1, wherein the handle further comprises a trigger mechanism operatively connected to the reciprocating cylinder to actuate the reciprocating cylinder.

3. The automated shingle removal machine of claim 2, wherein the reciprocating cylinder comprises a proportional reciprocating cylinder wherein movement of the lever member and edge means is proportional to trigger actuation, and wherein the movement provides variable stroke lengths.

4. The automated shingle removal machine of claim 3, wherein the reciprocating cylinder comprises a pneumatic cylinder.

5. The automated shingle removal machine of claim 3, wherein the reciprocating cylinder comprises a hydraulic cylinder.

6. The automated shingle removal machine of claim 3, wherein the reciprocating cylinder comprises an electrical cylinder.

7. The automated shingle removal machine of claim 1, wherein actuation of the reciprocating cylinder causes the edge means to be adjusted upwardly in a plane orthogonal to the top portion of the housing.

8. The automated shingle removal machine of claim 1, wherein the housing further comprises a bottom pan having at least one embossment to facilitate sliding of the machine on the roof surface.

9. The automated shingle removal machine of claim 7, wherein the machine further comprises a pivot shaft attaching the lever member to the housing at a point substantially intermediate between the proximal end and the distal end of the lever member such that the upward adjustment of the edge means is vertical and does not exert a backward force on the machine.

10. The automated shingle removal machine of claim 9, wherein the housing further comprises a bottom pan having at least one embossment to at least one flange to facilitate sliding of the mechanism on a surface, and further wherein the bottom pan is replaceable.

11. The automated shingle removal machine of claim 1, wherein the edge means is replaceable.

12. The automated shingle removal machine of claim 1, wherein the handle is adjustable to multiple positions through mechanical fasteners that engage mounting holes in side portions of the housing.

13. The automated surface covering removal machine of claim 10, wherein the edge means comprises a plurality of teeth, the teeth oriented substantially parallel to the bottom pan wherein the teeth engage and remove nails holding shingles to the roof surface when the teeth of the edge means are adjusted upwardly.

14. The automated shingle removal machine of claim 4, wherein the reciprocating pneumatic cylinder further comprises quick exhaust valves that increase the response speed of the lever member during activation.

15. The automated shingle removal machine of claim 14, wherein the quick exhaust valves are located within the housing, the exhaust from the valves creating a positive pressure in the housing to cleans an interior portion of the housing.

16. An automated surface covering removal machine comprising:

a handle;

the handle being connected to a housing in an adjustable manner at a connection location;

the housing fully enclosing a user-acuatable, proportional reciprocating cylinder, the housing having a top portion, a first side portion, a second side portion and a sloped front surface;

the proportional reciprocating cylinder being mounted to the top portion of the housing and further being operatively connected to a lever member at a proximal end of the lever member;

a pivot shaft attaching the lever mechanism to the first and second side portions of the housing, the pivot shaft located at a point substantially intermediate to the proximal end of the lever member and a distal end of the lever member; and a removable edge means connected to the lever member at the distal end, the removable edge means adapted to move under a surface covering applied to a surface;

wherein when the proportional reciprocating cylinder is actuated, the lever member and edge means are adjusted upwardly orthogonal to the top portion of the housing to facilitate removal of the surface covering.

17. The automated surface covering removal machine of claim 16, wherein the handle further comprises a trigger mechanism operatively connected to the reciprocating cylinder to actuate the reciprocating cylinder, such that the lever member and edge means are adjusted upwardly in proportion to actuation of the trigger mechanism.

18. The automated surface covering removal machine of claim 16, wherein the reciprocating cylinder comprises a pneumatic cylinder.

19. The automated surface covering removal machine of claim 16, wherein the reciprocating cylinder comprises a hydraulic cylinder.

20. The automated surface covering removal machine of claim 16, herein the reciprocating cylinder comprises an electrical cylinder.

21. The automated surface covering removal machine of claim 16, wherein the housing further comprises a bottom pan having at least one embossment to facilitate sliding of the machine on the surface.

22. The automated surface covering removal machine of claim 16, wherein the surface is a floor.

23. The automated surface covering removal machine of claim 16, wherein the surface is a roof.

24. The automated surface covering removal machine of claim 16, wherein the upward adjustment of the tooth bar is vertical and does not exert a backward force on the machine.

25. The automated surface covering removal machine of claim 21, wherein the bottom pan is replaceable.

26. The automated surface covering removal machine of claim 16, wherein the removable edge means comprises a toothed edge means, a flat edge means, a serrated edge means, a bladed edge means or a chisel edge means.

27. The automated surface covering removal machine of claim 18, wherein the pneumatic proportional reciprocating cylinder further comprises quick exhaust valves to increase the response speed of the lever member during activation.

28. The automated surface covering removal machine of claim 27, wherein exhaust from said quick exhaust valves creates a positive pressure with the housing to cleans an interior portion of the housing.

* * * * *